United States Patent [19]

Healey, Jr.

[11] 3,983,525

[45] Sept. 28, 1976

[54] ELECTRIC FUSE AND TUBE MATERIAL ADAPTED FOR USE AS FUSE CASING

[75] Inventor: Daniel P. Healey, Jr., Merrimacport, Mass.

[73] Assignee: The Chase-Shawmut Company, Newburyport, Mass.

[22] Filed: June 30, 1975

[21] Appl. No.: 591,629

Related U.S. Application Data

[63] Continuation-in-part of Ser. No. 579,972, May 22, 1975.

[52] U.S. Cl. ..... 337/186; 337/414

[51] Int. Cl.[2] ..... H01H 85/20

[58] Field of Search ..... 337/158, 186, 414, 415

[56] References Cited

UNITED STATES PATENTS

| | | | |
|---|---|---|---|
| 3,723,930 | 3/1973 | Koch | 337/158 |
| 3,750,075 | 7/1973 | Cooper | 337/158 |
| 3,911,385 | 10/1975 | Blewitt et al. | 337/186 X |

*Primary Examiner*—George Harris
*Attorney, Agent, or Firm*—Erwin Salzer

[57] ABSTRACT

An electric fuse has a casing of synthetic-resin-glass-cloth laminate which includes a plurality of reinforcement plies - of woven glass fiber cloth - to the exclusion of any non-woven mat material. There are along the wall of the casing cyclically alternating regions of relatively large and relatively small glass-to-resin content, which allows to impart substantially the same wall thickness to the entire perimeter of the casing.

3 Claims, 3 Drawing Figures

ZH= zones of large ratio of glass-fibers-resin content

ELECTRIC FUSE AND TUBE MATERIAL ADAPTED FOR USE AS FUSE CASING

BACKGROUND OF THE INVENTION

This is a continuation-in-part of my copending patent application filed 05/22/1975, Ser. No. 579,972 for ELECTRIC FUSE HAVING A MULTIPLY CASING OF SYNTHETIC RESIN-GLASS-CLOTH LAMINATE.

The above patent application solves primarily the problem of providing electric fuses having casings that have a high degree of dynamic bursting strength, and which casings lend themselves to be manufactured cost-effectively by the pultrusion process. The casing or tube structure disclosed in the parent application includes a minimum of three re-inforcement plies of glass fibers, namely (1) an outermost ply of woven glass fiber fabric, (2) an innermost ply of woven glass fiber fabric, and (3) an intermediate ply formed by a non-woven mat of substantially non-uniformly oriented glass fibers. At least the outermost ply and the innermost ply have an extent in excess of 360° and form overlaps. The three plies are integrated by a thermosetting resin into a tubular laminate having virtually uniform wall thickness along the entire periphery thereof. The function of the intermediate ply is of crucial importance. It greatly contributes to the resiliency and dynamic strength of the material, and greatly facilitates the maintenance of virtually uniform wall thickness in the presence of a plurality of regions of ply overlap.

I have found that there are instances where the intermediate re-inforcement ply formed by a non-woven mat of substantially non-uniformly oriented, or random oriented, glass fibers may be dispensed with, and yet a casing or tubing material obtained that has a very high dynamic bursting strength and is adequate for various applications.

SUMMARY OF THE INVENTION

Fuses embodying this invention include a tubular casing of synthetic resin glass-cloth laminate housing the fusible element and the pulverulent arc-quenching filler, and supporting a pair of terminal elements for connecting the fusible element into an electric circuit. The aforementioned casing comprises a plurality of overlapping re-inforcement plies of woven glass fiber cloth, excluding any non-woven mat material with non-uniformly oriented fibers. Each of said plurality of plies forms an overlap angularly displaced relative to said overlap of all others of said plurality of plies. The wall of said casing includes first regions where the ratio of glass-to-resin content is relatively large and the wall of said casing includes second regions where the ratio of glass-to-resin content is relatively small, said first regions and said second regions alternating along the entire perimeter of said casing in such a way that the wall thickness of said casing is substantially uniform throughout the entire perimeter thereof.

DESCRIPTION OF PREFERRED EMBODIMENT

Figure 1:
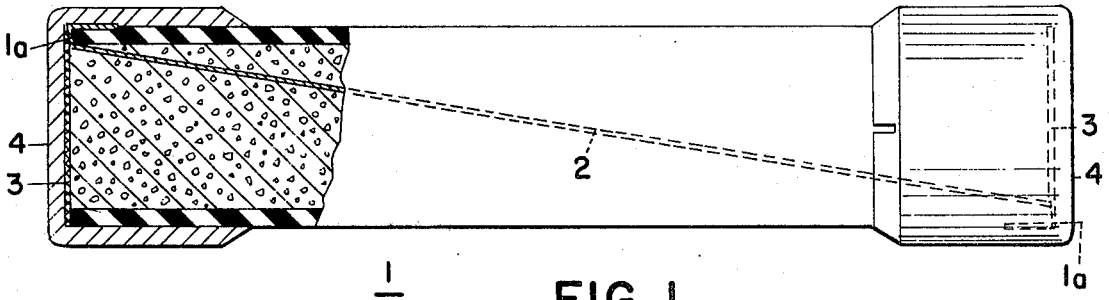
FIG. 1 is in part a longitudinal section and in part a front elevation of an electric cartridge fuse embodying this invention.

In the drawing numeral 1 has been applied to generally indicate a tubular casing of synthetic-resin-glass-cloth laminate. Casing 1 houses a fusible element 2, e.g. a multiperforated ribbon of silver. The ends of fusible element 2 are bent around the rims 1*a* of casing 1, and engage the outer surface thereof. Casing 1 is filled with a body of pulverulent arc-quenching filler, preferably quartz sand which embeds fusible element 2. The ends of casing 1 are closed by a pair of thin disks 3, preferably of asbestos. A pair of terminal elements or ferrules 4 is mounted on the ends of casing 1 and presses the ends of fusible element 2 which are positioned outside of casing 1 against the outer surface of the latter. If desired, additional means may be provided to improve the conductive connection between the ends of fusible element 2 and the inner surfaces of ferrules 4. This may be effected, for instance, by so-called blind solder joints.

Figure 2:
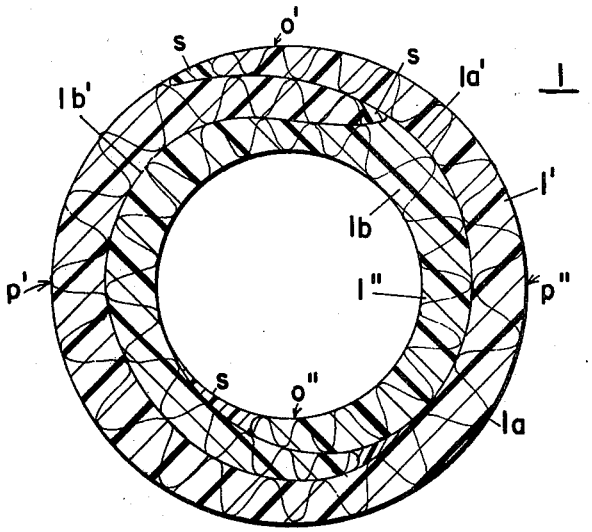
FIG. 2 is a diagrammatic cross-section of the casing structure of FIG. 1, drawn on a much larger scale than FIG. 1, which casing includes but two superimposed layers of glass fiber fabric.

As clearly shown in FIG. 2 casing 1 includes but two re-inforcement plies 1′ and 1″, each of woven glass fiber cloth excluding any non-woven mat material. Ply 1′ defines the outer surface of casing 1 and overlaps in the region *o*′ with itself. In other words, the extent of ply 1′ is in excess of 360°. Ply 1″ defines the inner surface of casing 1 and overlaps in the region *o*″ with itself. As is apparent from FIG. 2 the juxtaposed regions *o*′ and *o*″ are formed by three superimposed re-inforcement layers of woven glass fiber cloth. The re-inforcement insert of tubing or casing 1 further includes two substantially juxtaposed regions *p*′ and *p*″ where the re-inforcement insert of casing 1 is formed by but two superimposed layers of woven glass fiber cloth. In the regions *o*′,*o*″ the ratio of glass-to-resin content is relatively high and in the regions *p*′,*p*″ the ratio of glass-to-resin content is relatively small. This change of the ratio of the glass-to-resin content along the perimeter, or circumference, of casing 1 makes it possible to maintain its wall thickness substantially uniform throughout its range of 360°. It will be noted that the edges of plies 1′,1″ are feathered, i.e. thinned. There are small spaces s in the casing wall which hardly include any glass fibers but are solely filled by synthetic resin. Due to their smallness, the presence of non glass-fiber re-inforced spaces in casing 1 has no adverse effects on the mechanical properties, or performance characteristics, thereof.

The casing material which has been disclosed above is not limited to use in connection with electric fuses but may be used in other applications where like requirements obtain.

Considering again FIG. 2, it will be apparent that the radially other surface 1*a* of ply 1′ is coextensive with the outer surface of tubing or casing 1 and that the radially inner surface 1*b* of ply 1″ is coextensive with the inner surface of tubing or casing 1. It will be further apparent that in certan portions of the cross-section of tubing 1 — i.e. where there is no ply-overlap — the inner surface 1*a*′ of ply 1′ and the outer surface 1*b*′ of ply 1″ are coextensive, and that there is no intermediate fibrous layer between surfaces 1*a*′ and 1*b*′. Casing 1 forms regions *o*′,*p*″,*o*″,*p*′ wherein the ratio of glass-fiber-to-resin content varies cyclically. These cyclical variations make it possible to maintain the wall thickness of tubing 1 substantially uniform throughout the entire perimeter thereof. The regions of relatively high ratio of glass-fiber-to-resin content are the regions *o'* and *o''* and the regions of relatively low ratio of glass-fiber-to-resin content are regions *p'* and *p''*.

Figure 3:
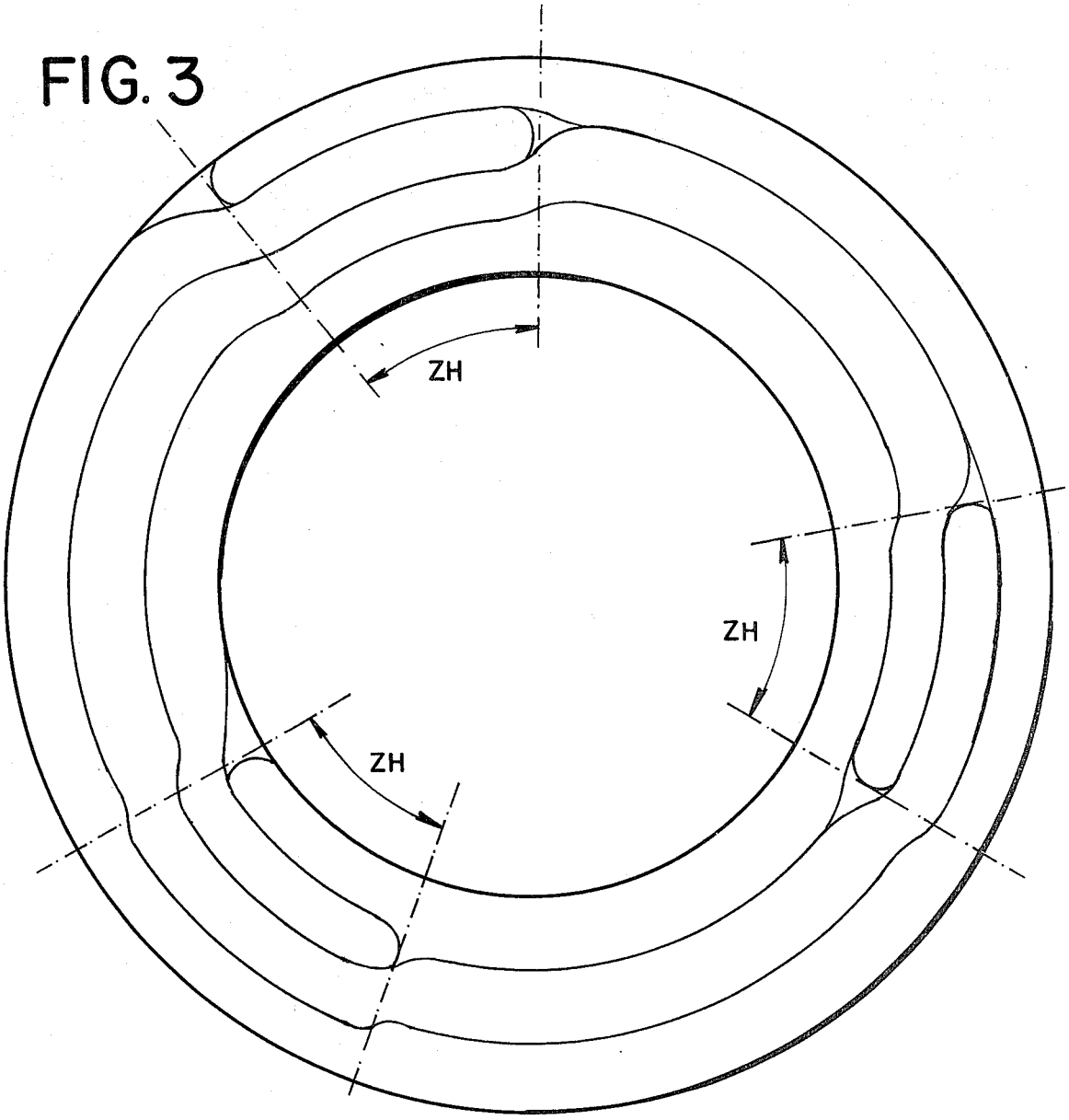
FIG. 3 is a diagrammatic representation of a casing or tube material made up of three rather than but two re-inforcement plies.

FIG. 3 shows, in substance, the same arrangement of plies as FIG. 2, but in a more diagrammatic fashion and on a larger scale. In FIG. 3 the reference character ZH has been applied to indicate the regions where the three constituent plies of a tubing according to this invention overlap, each of its constituent plies being formed by woven glass fiber cloth, intermediate plies of non-woven mat material being eliminated. The ratio of glass-to-resin content is relatively large in the three regions ZH which are angularly displaced 120°. Each of the regions ZH where the glass-to-resin content is relatively large alternates with a region where the ratio of glass-to-resin content is relatively small. There are three such regions which are angularly displaced about 120°. Because of the variation of the ratio of glass-to-resin content in regions ZH on one hand, and in the intermediate regions, on the other hand, the wall thickness of the tubing is substantially uniform throughout the entire perimeter thereof.

I claim as my invention:

1. In an electric fuse the combination of a. a fusible element;

b. a body of pulverulent arc-quenching filler embedding said fusible element;

c. a pair of terminal elements are arranged adjacent one of the ends of said fusible element for connecting said fusible element into an electric circuit; and d. a tubular casing of synthetic-resin-glass-cloth laminate housing said fusible element and said filler and supporting said pair of terminal elements, said casing having a plurality of re-inforcement plies of woven glass fiber cloth excluding any non-woven mat material, each of said plurality of plies forming an overlap angularly displaced relative to said overlap of all others of said plurality of plies, the wall of said casing including first regions where the ratio of the glass-to-resin content is relatively large and the wall of said casing including second regions where the ratio of glass-to-resin content is relatively small, said first regions and said second regions alternating along the entire perimeter of said casing, so that the wall thickness of said casing is substantially uniform throughout the entire perimeter thereof.

2. An electric cartridge fuse including a casing of synthetic glass-cloth laminate, terminal elements mounted on the ends of said casing, fusible element means conductively interconnecting said terminal elements, and a pulverulent arc-quenching filler embedding said fusible element means, wherein the improvement comprises in that the re-inforcement of said casing consists of a plurality of sheets of woven glass fiber cloth all of whose radially inner surfaces are in immediate engagement without interposition of any non-woven fibrous mat material, each of said plurality of sheets forming an overlap extending in a direction longitudinally of said casing, said overlap of each of said plurality of sheets being angularly displaced relative to said overlap of all others of said plurality of sheets, and said casing forming cyclically alternating regions wherein the ratio of glass-fiber-to-resin content varies so that the wall thickness of said casing is substantially uniform throughout the perimeter thereof.

3. A synthetic-resin-glass-cloth laminate tubing having a plurality of fibrous re-inforcement plies of woven glass fiber cloth excluding any intermediate fibrous plies of non-woven mat material, each of said plurality of plies forming an overlap angularly displaced relative to said overlap of all others of said plurality of plies, the wall of said tubing including first regions where the ratio of the glass-to-resin content is relatively large and the wall of said tubing including second regions where the ratio of the glass-to-resin content is relatively small, said first regions and said second regions alternating along the entire perimeter of said tubing, so that the wall thickness of said tubing is substantially uniform throughout the entire perimeter thereof.

* * * * *